US006092533A

United States Patent [19]

Moses

[11] Patent Number: 6,092,533

[45] Date of Patent: Jul. 25, 2000

[54] PORTABLE CIGAR HUMIDIFIER

[76] Inventor: Jeffrey J. Moses, 355 Santa Fe Dr. Suite 100, Encinitas, Calif. 92024

[21] Appl. No.: 09/232,211

[22] Filed: Jan. 19, 1999

[51] Int. Cl.[7] ..... A24B 3/10; A24B 1/02; A24F 13/00; B43K 8/12; B65D 81/24

[52] U.S. Cl. ..... 131/329; 131/290; 131/300; 401/207; 401/196; 206/205

[58] Field of Search ..... 131/329, 300, 131/309, 310, 330, 290, 328, 274; 312/31; 401/196, 207; 261/94, 95, 101; 206/204, 205; 15/244.1, 104.04

[56] References Cited

U.S. PATENT DOCUMENTS 3,189,935 6/1965 Euga ..... 15/104.04

*Primary Examiner*—James Derrington
*Assistant Examiner*—Dionne A. Walls
*Attorney, Agent, or Firm*—Henri J. A. Charmasson; John D. Buchaca

[57] ABSTRACT

A portable and compact cigar humidifier has a pull-out member encasing a slab of spongy material. A pair of circular windows cut through opposite walls of the member have a diameter slightly larger than the maximum diameter of a conventional cigar. A circular aperture in the spongy material slab is co-axiallly aligned with the windows, and has a diameter slightly less than the minimum diameter of a conventional cigar. The spongy material is implemented with an aromatic liquid. A cigar can be passed through the windows and aperture to humidify its outer skin.

8 Claims, 1 Drawing Sheet

PORTABLE CIGAR HUMIDIFIER

FIELD OF THE INVENTION

This invention relates to cigar humidors and similar moisturizing enclosures.

BACKGROUND OF THE INVENTION

It is well-known that excessive dryness can adversely affect the flavor of a cigar. Accordingly, it is customary to keep cigars in humidors and similar enclosures provided with a moisturizing source in watertight packages which prevent evaporation of the natural tobacco moisture. Humidors and watertight enclosures are seldom provided in a small size, that would conveniently fit within a lady's handbag or a gentleman's pocket. Accordingly, a cigar carried in such a fashion, has often lost some of its moisture and flavor. In most instances, the problem is palliated by licking the skin of the cigar before lighting it. This licking operation is not very dignified and may be considered repugnant especially when done by a lady in polite company.

This invention results from an attempt to find a practical and dignified method for quickly restoring the moisture of a cigar.

SUMMARY OF THE INVENTION

The principal and secondary objects of this invention are to provide a compact implement for quickly humecting the surface of a cigar which implement is sized to be carried unobtrusively in a lady's handbag or gentlemen's pocket.

These and other valuable objects are achieved by a container holding a slab of spongy material saturated with an aromatic liquid. Opposite walls of the container are pierced with circular holes having a diameter slightly larger than the maximum diameter of most popular size cigars, and where the slab has a corresponding aperture whose diameter is slightly smaller than the minimum diameter cross-section of such a cigar which commonly has a variable cross-sectional diameter. A series of radial slits in the part of the slab exposed by the windows provide for a wiping movement of the spongy material over the skin of the cigar as it is passed through the opening.

DESCRIPTION OF THE PREFERRED EMBODIMENT OF THE INVENTION

Figure 1:
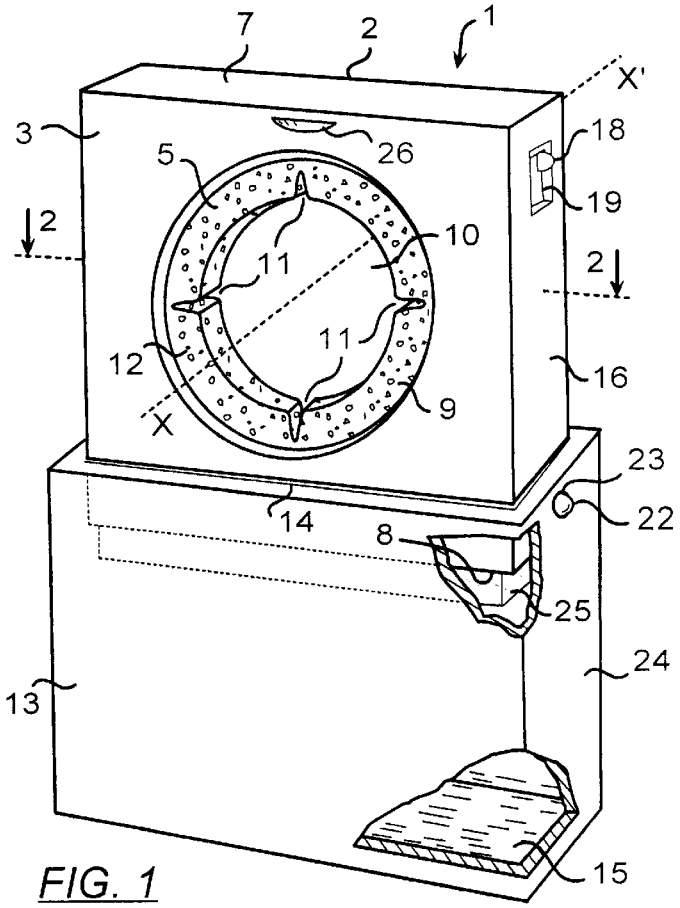
FIG. 1 is a perspective view of a first embodiment of the invention.
Figure 2:
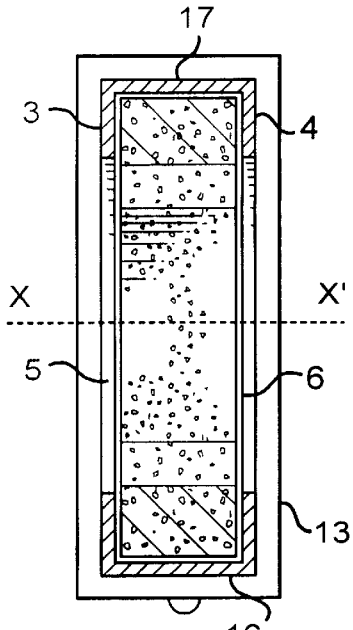
FIG. 2 is a cross-sectional view taken along line 2—2 of FIG. 1.
Figure 4:
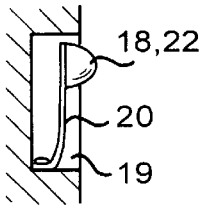
FIG. 4 is a cross-sectional view of the locking nib mechanism.

Referring now to the drawing, there is shown a first embodiment of the invention 1 which comprises a rectangular container 2 having a first pair of opposite walls 3 and 4 which are pierced with two symmetrical apertures centered about a transversal axis X–X' perpendicular to the first pair of walls 3 and 4. The diameter of the aperture is approximately 35 mm (1.5 inches) that is slightly larger than the maximum cross-sectional diameter of most cigars. The container has a top-end cover 7 and an open bottom end 8. Sandwiched between the pair of opposite walls, is a slab 9 of spongy material, preferably, an open-cell synthetic foam or a multi-ply felt pad. A circular aperture 10 is cut through the slab of foam concentrically with the windows 5 and 6. The diameter of the opening 10 can be as small as approximately 15 mm (⅝ inch) which is approximately commensurate with the diameter of the smallest cross-section of most cigars. A series of radial slits 11 are cut into the exposed portion 12 of the spongy material slab 9. The container 2 can be intimately nested into a vessel or receptacle 13 whose internal cavity 14 has the same shape and dimensions as the container 2. The vessel 13 holds a small amount of liquid 15, preferably water flavored with a mint extract or other herbal extracts.

On one of a second pair of opposite walls 16 and 17, which are perpendicular and joined to the first pair of walls 3 and 4, and to the top end cover 7, is a round-head nib 18 nested in a small recess 19 and outwardly biased by a lift-spring 20 so that the head of the nib has a tendency to pop out of the cavity but may be pushed in flush with the side wall 16 by finger pressure. A similar nib 22 and associated mechanism is provided near the lower edge of the side wall 16. A hole 23 having a diameter commensurate with the common diameter of the nibs 18 and 22 is bored through a side wall 24 of the vessel and is positioned to receive the lower nib 22 when the container is in its open, extended position shown in FIG. 1, and the upper nib 18 when the container is pushed down into the vessel. In the last position, a bottom section 25 of the slab 9 of spongy material is squeezed against the bottom of the vessel while being in constant contact with the fluid 15. By applying repeated pushing movements to the top of the container against the resilience of the bottom section 25 of the slab, one can create a pumping action that helps spread the liquid 15 throughout the slab 9. A thumbnail-sized depression 26 near the top edge of the container facilitates its extraction from the vessel 13.

Figure 3:
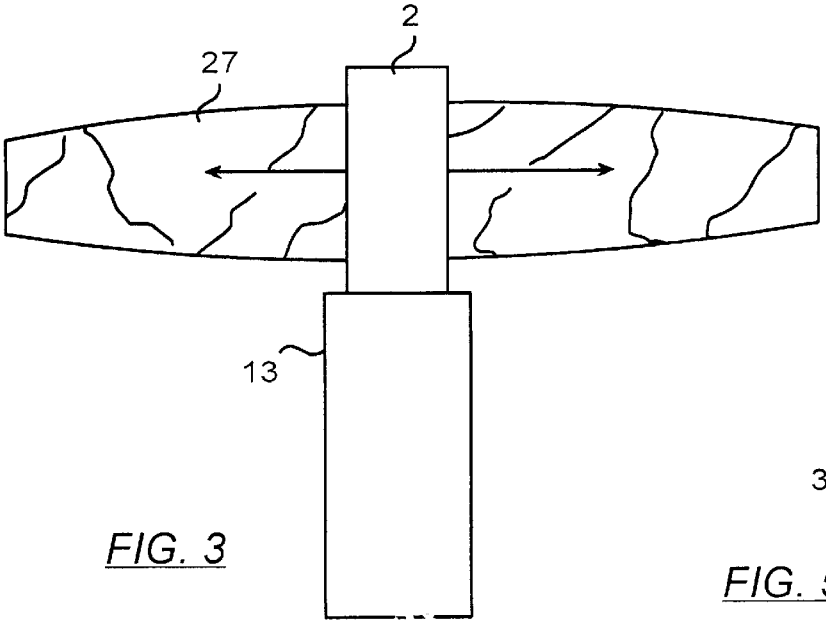
FIG. 3 is a side elevational view of the device in use over a cigar.

When a cigar is passed through the aperture 10 in one or both directions as illustrated in FIG. 3, the exposed slited edge of the slab around the aperture 10 are wiped over the outer surface of the entire cigar.

Figure 5:
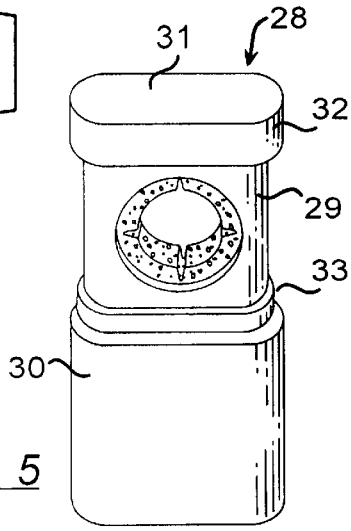
FIG. 5 is a perspective view of an alternate embodiment of the invention.

In the alternate embodiment 28 of the invention illustrated in FIG. 5, the container 29 and the vessel 30 have stylish oval cross-sections. The container is provided with a cover 31 that has a rim 32 shaped and dimensioned to closely fit the upper peripheral edge 33 of the vessel, thus providing a tight and waterproof seal.

While the preferred embodiments of the invention have been described, modifications can be made and other embodiments may be devised without departing from the spirit of the invention and the scope of the appended claims.

What is claimed is:

1. A device for humecting an oblong smoking article of variable cross-sectional diameter, said smoking article having a maximum cross-sectional diameter and a minimum cross-sectional diameter, said device comprising:

a pocket-carryable container having a first pair of opposite walls, each of said walls having a circular aperture therethrough of a diameter larger than said maximum cross-sectional diameter;

said apertures being substantially aligned about a common central axis;

a slab of spongy material held between said walls, and having a window cut therethrough in axial alignment with said apertures and wherein said slab has a plurality of slits extending radially and outwardly from said window;

said window having a maximum dimension lesser than the maximum cross-sectional diameter of said article; and a humecting liquid dispersed through said slab.

2. The device of claim 1, wherein said window is circular, and has a diameter lesser than the minimum cross-sectional diameter of said article.

3. The device of claim 1, which further comprises a vessel having a central cavity shaped and dimensioned to intimately receive said container.

4. The device of claim 3, wherein said container further comprises:

an second pair of opposite walls perpendicular and joined to said first pair of opposite walls;

an end wall perpendicular and joined to said first and second pairs of opposite walls to form, around said slab, a box having a constant transversal cross-section parallel to said end wall; and wherein said vessel has an internal cavity and an opening commensurate with said transversal cross-section;

whereby said container can be inserted into said cavity through said opening.

5. The device of claim 3, wherein said vessel holds a volume of said liquid.

6. The device of claim 2, wherein said container has an outer shape and dimensions substantially commensurate with said cavity.

7. The device of claim 3, which further comprises means for releasably limiting the extraction of said container out of said vessel.

8. The device of claim 7, which further comprises means for releasably securing said container within said vessel.

* * * * *